US005667953A

United States Patent [19]

Bertoldi et al.

[11] Patent Number: 5,667,953

[45] Date of Patent: Sep. 16, 1997

[54] SILVER HALIDE PHOTOGRAPHIC MATERIAL COMPRISING MERCAPTOTETRAZOLE COMPOUND(S)

[75] Inventors: Massimo Bertoldi, Fossano, Italy; Mark P. Kirk, Bishop's Stortford, United Kingdom

[73] Assignee: Minnesota Mining and Manufacturing Company, St. Paul, Minn.

[21] Appl. No.: 511,072

[22] Filed: Aug. 3, 1995

[30] Foreign Application Priority Data

Sep. 13, 1994 [EP] European Pat. Off. ..... 94114342

[51] Int. Cl.[6] ..... G03C 1/005; G03C 1/08

[52] U.S. Cl. ..... 430/567; 430/598; 430/600; 430/601; 430/611; 430/614

[58] Field of Search ..... 430/567, 564, 430/598, 600, 601, 611, 614

[56] References Cited

U.S. PATENT DOCUMENTS

| | | | |
|---|---|---|---|
| 5,025,164 | 6/1991 | Sidwell et al. | 250/483.1 |
| 5,192,647 | 3/1993 | Kojima et al. | 430/448 |
| 5,219,720 | 6/1993 | Black et al. | 430/567 |
| 5,290,674 | 3/1994 | Hirano et al. | 430/611 |
| 5,376,521 | 12/1994 | Inoue et al. | 430/567 |
| 5,411,849 | 5/1995 | Hasegawa | 430/567 |

FOREIGN PATENT DOCUMENTS

| | | | |
|---|---|---|---|
| 154293 | 9/1985 | European Pat. Off. | 430/611 |
| 0 547 912 A1 | 6/1993 | European Pat. Off. . | |
| 0 600 308 A1 | 6/1994 | European Pat. Off. . | |
| 59-200230 | 11/1984 | Japan | 430/598 |
| 6-175266 | 6/1994 | Japan . | |

OTHER PUBLICATIONS

United States Statutory Invention Registration H1063, Hosoi, Jun. 2, 1992.

Chemical Abstracts 122:20358 Corresponding to JP 6–175266.

International Patent Application Published under the PCT on Nov. 28, 1991 as Application No. WO 91/18320 (Claims and Abstract only).

"Organic Compounds and Their Pharmaceutical Use," by Stephen Baker, et al., European Patent Application No. EP 134.111 (CI.C07C149/273) (Abstract only).

European Patent Application No. 93/118,552.6.

*Primary Examiner*—Thorl Chea

*Attorney, Agent, or Firm*—Carolyn A. Bates; Gregory A. Evearitt; Mark A. Litman

[57] ABSTRACT

The present invention relates to a light-sensitive silver halide photographic material comprising a support and silver halide emulsion layer or layers, wherein at least one of said silver halide emulsion layers comprises an alkylaminomercaptotetrazole antifoggant. According to a preferred embodiment of the present invention said silver halide emulsion layer comprises tabular silver halide grains having an average aspect ratio higher than 3:1 and a thickness lower than 0.4 μm.

12 Claims, No Drawings

SILVER HALIDE PHOTOGRAPHIC MATERIAL COMPRISING MERCAPTOTETRAZOLE COMPOUND(S)

FIELD OF THE INVENTION

The present invention relates to a silver halide photographic material, particularly to a black and white radiographic element, which comprises an alkylaminomercaptotetrazole compound particularly useful to increase the speed to D.min ratio.

BACKGROUND OF THE INVENTION

Tabular silver halide grains are hexagonal or triangular crystals possessing two (1,1,1) major faces that are substantially parallel in which the average diameter of said faces is at least two times (and often more times) the distance separating them.

Silver halide photographic emulsions containing a high proportion of tabular grains have advantages of good developability, improved covering power and increased useful adsorption of sensitizing dye per weight of silver due to their higher surface area-to-volume ratio. The use of such emulsions in photographic materials is disclosed in U.S. Pat. Nos. 4,425,425, 4,433,048, 4,435,499, 4,439,520, and other related patents.

However, photographic materials containing tabular silver halide grains also have certain disadvantages. One of these is that they tend to easily fog under high temperature accelerated processing. Therefore, tabular silver halide grains are not satisfactory for use in photographic emulsions requiring high sensitivity and low fog.

Various additives, such as stabilizers and antifoggants, are used in ordinary light-sensitive silver halide photographic materials for minimizing the rise of fog in dependence of the development processing conditions. For example, nitrobenzimidazoles, mercaptothiazoles, benzotriazoles, nitrobenzotriazoles, mercaptotetrazoles, etc., are described as such additives in E. J. Birr, *Stabilization of Photographic Silver Halide Emulsions*, Focal Press, and in U.S. Pat. Nos. 3,954,474, 3,982,974, etc. However, while these additives can depress an increase of fog in a light-sensitive silver halide photographic material containing tabular grains during high temperature processing to some extent, a decrease in sensitivity also occurs.

For example, it is known to use light-sensitive silver halide photographic materials in high-temperature development processing using automatic developing machines. To enhance the physical strength of the photographic materials during the development at high temperature and in automatic developing machines and prevent them from becoming physically fragile it is known to conduct the processing with an aldehyde hardener in the developing solution. However, a developing process with a developing solution containing an aldehyde, particularly an aliphatic dialdehyde, concurrently causes an increase of fog, particularly as the temperature of the developing solution increases. The fog can be depressed to some extent by using strong antifogging agents such as benzotriazole and 1-phenyl-5-mercaptotetrazole in the developing solutions (as described in L. F. Mason, *Photographic Processing Chemistry*, Focal Press). However, these antifogging agents, when used to develop light-sensitive silver halide photographic materials containing tabular silver halide grains, concurrently depress development and reduce emulsion sensitivity.

Aromatic hydroxy compounds such as α-naphthol, pyrocatechol, resorcinol, methoxyphenol or naphthosulfonic acid have been disclosed for preventing latent image regression in DE 1,107,508. 1,3-Dihydroxybenzene carboxylic compounds have been disclosed in U.S. Pat. No. 3,380,828 to prevent stain formation in unhardened silver halide emulsions comprising a developing agent and a hardener precursor for use in rapid processing systems. 2,5- and 3,5-dihydroxybenzene carboxylic acids have been described in DE 1,171,266 to decrease fog in fresh and stored silver halide emulsions. No reference is made in these patents to silver halide emulsions comprising tabular silver halide grains.

Reducing agents, such as chromans, tocopherols, hydrazines, p-phenylenediamines, aldehydes, aminophenols, phenidones, sulfites, $H_2$ gas, sulfinic acids, di- or tri-hydroxybenzenes, endiols, oximes and reducing sugars, are disclosed in DE 3,615,336 as added to silver halide emulsions containing tabular grains produced in the presence of an oxidant compound, such as $H_2O_2$, a peroxy-acid salt and $O_3$. The reducing agent is deactivated or reduced during or after the chemical ripening.

Co-pending European Patent Application 93/118552.4, filed on behalf of the same assignee, describes the use of phenylmercaptotetrazole with a carbamoyl substituent in the para position of a phenyl ring as antifogging agent for color photographic materials against magenta processing variability.

U.S. Pat. No. 5,192,647 discloses the use of carbamoyl-substituted benzotriazole compounds in methods of processing silver halide photographic materials to reduce the formation of developer fog.

SUMMARY OF THE INVENTION

The present invention relates to a light-sensitive silver halide photographic material comprising a support and silver halide emulsion layer or layers coated thereon, wherein at least one of said silver halide emulsion layers comprises an alkylaminomercaptotetrazole compound. According to a preferred embodiment of the present invention said silver halide emulsion layer comprises tabular silver halide grains having an average aspect ratio higher than 3:1 and a thickness lower than 0.4 μm.

DETAILED DESCRIPTION OF THE INVENTION

Accordingly, the present invention relates to a silver halide photographic element comprising at least one silver halide emulsion layer coated on a support, at least one of said silver halide emulsion layer of said photographic element comprising an alkylaminomercaptotetrazole compound.

The alkylaminomercaptotetrazoles useful in the material of the present invention can be represented by the following formula (I):

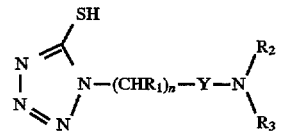

(I)

In the above formula (I) Y is a divalent group selected from the group consisting of —CO—, —$SO_2$—, and —P(O)OR—, where R can be a hydrogen atom, an alkyl group or an aryl group; $R_1$, $R_2$ and $R_3$, each equal or different, can be hydrogen atom, alkyl group or aryl group; and n is an integer from 1 to 5.

According to a preferred embodiment, the alkylaminomercaptotetrazoles useful in the photographic material of the present invention can be represented by the following formula (II):

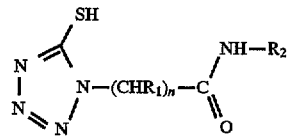

(II)

wherein $R_1$ and $R_2$, each equal or different, can be hydrogen atom, alkyl group or aryl group, and n is an integer from 1 to 5.

When the term "group" is used in this invention to describe a chemical compound or substituent, the described chemical material includes the basic group and that group with conventional substitution. When the term "moiety" is used to describe a chemical compound or substituent, only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, stearyl, cyclohexyl, etc.

Specific examples of the alkylaminomercaptotetrazoles useful in the photographic element of the present invention are the following:

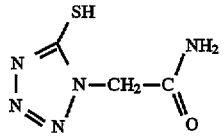

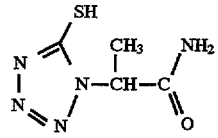

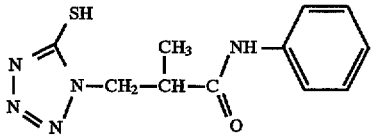

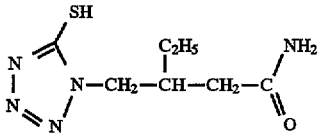

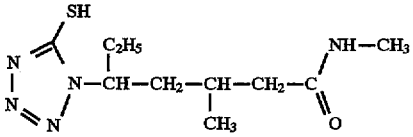

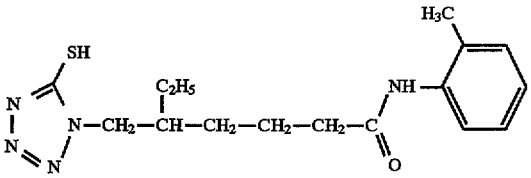

-continued

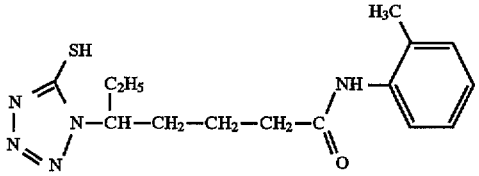

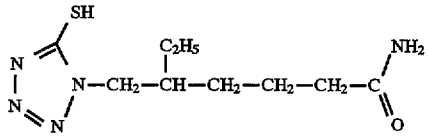

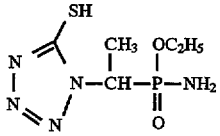

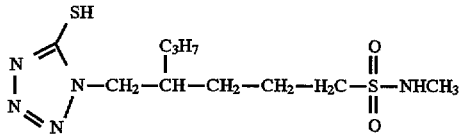

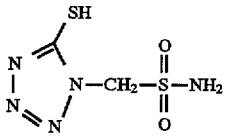

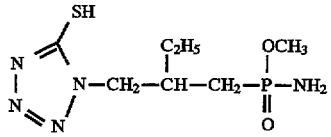

The alkyl mercaptotetrazoles of the present invention are added to silver halide photographic materials in an amount of from 0.01 to 1 mmol/molAg.

The alkyl mercaptotetrazoles of the present invention can be prepared according to methods well known in the art. Synthetic methods are described, for example, in A. Berges et al, Journal of Heterocyclic Chemistry, Vol. 15, page 984 et seq., (1978), wherein 4,5-hydro-5-thioxo-1H-tetrazole-1-propanoic acid was transformed into its acid chloride derivative using thionyl chloride and this intermediate was reacted with concentrate ammonium hydroxide to give the corresponding propanamide derivative. In EP 134,111 a 3-mercapto propionamide was obtained by the reaction of the methyl 3-mercapto propionate with an ammonia solution at 40° C. and nitrogen atmosphere for six hours. GB 1,570,147 describe the synthesis of 5-mercapto-1,2,4-oxadiazol-2-yl acetamide by the reaction of the corresponding ethyl acetate with $NH_3$ in ethanol at room temperature for 70 hours.

Photographic materials according to the invention generally comprise at least one light sensitive layer, such as a silver halide emulsion layer, coated on at least one side of a support.

Silver halide emulsions typically comprise silver halide grains which may have different crystal forms and sizes, such as, for example, cubic grains, octahedral grains, tabular grains, spherical grains and the like. Tabular grains are preferred. The tabular silver halide grains contained in the silver halide emulsion layers of this invention have an average diameter:thickness ratio (often referred to in the art as aspect ratio) of at least 3:1, preferably 3:1 to 20:1, more preferably 3:1 to 14:1, and most preferably 3:1 to 8:1. Average diameters of the tabular silver halide grains suitable for use in this invention range from about 0.3 to about 5 μm, preferably 0.5 to 3 μm, more preferably 0.8 to 1.5 μm. The tabular silver halide grains suitable for use in this invention have a thickness of less than 0.4 μm, preferably less than 0.3 μm and more preferably less than 0.2 μm.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 μm, as compared to the projected area of all of the silver halide grains in the layer. Other conventional silver halide grain structures such as cubic, orthorhombic, tetrahedral, etc. may make up the remainder of the grains.

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5% mol silver iodide. The halogen composition of individual grains may be homogeneous or heterogeneous.

Silver halide emulsions containing tabular silver halide grains can be prepared by various processes known for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257,in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appl. No. 263,508.

The silver halide emulsions may be sensitized by any procedure known in the photographic art. Sulfur containing compounds, gold and noble metal compounds, polyoxylakylene compounds are particularly suitable. In particular, the silver halide emulsions may be chemically sensitized with a sulfur sensitizer, such as allyl-thiocarbamide, thiourea, cystine, sodium thiosulfate, arylthio-sulfonates, arylsulfinates, allylthiourea, allylthiocyanate, etc.; an active or inert selenium sensitizer; a reducing sensitizer; a reducing sensitizer such as stannous salt, a polyamine, etc.; a noble metal sensitizer, such as gold sensitizer, more specifically potassium aurithiocyanate, potassium chloroaurate, chloroauric acid, gold sulfide, gold selenide, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

Moreover, the silver halide grain emulsion may be optically sensitized to a desired region of the visible spectrum. The method for spectral sensitization is not particularly limited. For example, optical sensitization may be possible by using an optical sensitizer, including a cyanine dye, a merocyanine dye, complex cyanine and merocyanine dyes, oxonol dyes, hemyoxonol dyes, styryl dyes and streptocyanine dyes, either alone or in combination. Useful optical sensitizers include cyanines derived from quinoline, pyridine, isoquinoline, benzindole, oxazole, thiazole, selenazole, imidazole. Particularly useful optical sensitizers are the dyes of the benzoxazole-, benzimidazole- and benzothiazole-carbocyanine type. Usually, the addition of the spectral sensitizer is performed after the completion of chemical sensitization. Alternatively, spectral sensitization can be performed concurrently with chemical sensitization, can entirely precede chemical sensitization, and can even commence prior to the completion of silver halide precipitation. When the spectral sensitization is performed before the chemical sensitization, it is believed that the preferential absorption of spectral sensitizing dyes on the crystallographic faces of the tabular grains allows chemical sensitization to occur selectively at unlike crystallographic surfaces of the tabular grains. In a preferred embodiment said spectral sensitizers produce J aggregates if adsorbed on the surface of the silver halide grains and a sharp absorption band (J-band) with a bathochromic shifting with respect to the absorption maximum of the free dye in aqueous solution.

It is known in the art of radiographic photographic material that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of said silver halide grains. Optimum dye concentration levels can be chosen in the range of 0.5 to 20 millimoles per mole of silver halide, preferably in the range of 2 to 10 millimoles.

Spectral sensitizing dyes producing J aggregates are well known in the art, as illustrated by F. M. Hamer, *Cyanine Dyes and Related Compounds*, John Wiley and Sons, 1964, Chapter XVII and by T. H. James, *The Theory of the Photographic Process*, 4th edition, Macmillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphth-oxazolium, naphthothiazolium and naphthoselenazolium quaternary salts.

To the above emulsion may also be added various additives conveniently used depending upon their purpose. These additives include, for example, stabilizers or antifoggants such as azaindenes, triazoles, tetrazoles, imidazolium salts, polyhydroxy compounds and others; developing promoters such as benzyl alcohol, polyoxyethylene type compounds, etc.; image stabilizers such as compounds of the chromane, cumaran, bisphenol type, etc.; and lubricants such as wax, higher fatty acids glycerides, higher alcohol esters of higher fatty acids, etc. Also, coating aids, modifiers of the permeability in the processing liquids, defoaming agents, antistatic agents and matting agents may be used. Other useful additives are disclosed in Research Disclosure, Item 17643, December 1978 in Research Disclosure, Item 18431, August 1979 and in Research Disclosure 308119, Section IV, 1989.

As a binder for silver halide emulsions and other hydrophilic colloid layers, gelatin is preferred, but other hydrophilic colloids can be used, alone or in combination, such as, for example, dextran, cellulose derivatives (e.g., hydroxyethylcellulose, carboxymethyl cellulose), collagen derivatives, colloidal albumin or casein, polysaccharides, synthetic hydrophilic polymers (e.g., polyvinyl-pyrrolidone, polyacrylamide, polyvinylalcohol, polyvinylpyrazole) and the like. Gelatin derivatives, such as, for example, highly deionized gelatin, acetylated gelatin and phthalated gelatin can also be used. It is also common to employ said hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like. Highly deionized gelatin is characterized by a higher deionization with respect to the commonly used photographic gelatins. Preferably, highly deionized gelatin is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of Ca++ ions and the significant presence of other ions.

Other layers and additives, such as subbing layers, surfactants, filter dyes, intermediate layers, protective layers, anti-halation layers, barrier layers, dye underlayers, development inhibiting compounds, speed-increasing agent, stabilizers, plasticizer, chemical sensitizer, UV absorbers and the like can be present in the radiographic element. Dye underlayers are particularly useful to reduce the cross-over of the double coated silver halide radiographic material. Reference to well-known dye underlayer can be found in U.S. Pat. No. 4,900,652, U.S. Pat. No. 4,855,221, U.S. Pat. Nos. 4,857,446, 4,803,150. According to a preferred embodiment, a dye underlayer is coated on at least one side of the support, more preferably on both sides of the support, before the coating of said at least two silver halide emulsions.

A detailed description of photographic elements and of various layers and additives can be found in Research Disclosure 17643 December 1978, 18431 August 1979, 18716 November 1979, 22534 January 1983, and 308119 December 1989.

Examples of materials suitable for the preparation of the support include glass, paper, polyethylene-coated paper, metals, polymeric film such as cellulose nitrate, cellulose acetate, polystyrene, polyethylene terephthalate, polyethylene, polypropylene and the like.

Specific photographic materials according to the invention are black-and-white light-sensitive photographic materials, in particular X-ray light-sensitive materials.

Preferred light-sensitive silver halide photographic materials according to this invention are radiographic light-sensitive materials employed in X-ray imaging comprising a silver halide emulsion layer(s) coated on one surface, preferably on both surfaces of a support, preferably a polyethylene terephthalate support. Preferably, the silver halide emulsions are coated on the support at a total silver coverage in the range of 3 to 6 grams per square meter. Usually, the radiographic light-sensitive materials are associated with intensifying screens so as to be exposed to radiation emitted by said screens. The screens am made of relatively thick phosphor layers which transform the X-rays into more imaging-effective radiation such as light (e.g., visible light). The screens absorb a larger portion of X-rays than the light-sensitive materials do and are used to reduce the X-ray dose necessary to obtain a useful image. According to their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes absorbed on the surface of the silver halide grains as known in the art.

More preferred light-sensitive silver halide photographic materials according to this invention are radiographic light-sensitive materials which employ intermediate diameter-:thickness ratio tabular grain silver halide emulsions, as disclosed in U.S. Pat. No. 4,425,426 and in EP Pat. Appl. 84,637.

However other black-and-white photographic materials, such as lithographic light-sensitive materials, black-and-white photographic printing papers, black-and-white negative films, as well as light-sensitive photographic color materials such as color negative films, color reversal films, color papers, etc. can benefit of the use of the present invention.

The silver halide photographic materials of the present invention are preferably fore-hardened. Typical examples of organic or inorganic hardeners include chrome salts (e.g., chrome alum, chromium acetate), aldehydes (e.g., formaldehyde and glutaraldehyde), isocyanate compounds (hexamethylene diisocyanate), active halogen compounds (e.g., 2,4-dichloro-6-hydroxy-s-triazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), active vinyl derivatives (e.g., vinylsulfonyl and hydroxy substituted vinylsulfonyl derivatives) and the like. Other references to well known hardeners can be found in *Research Disclosure*, December 1989, Vol. 308, Item 308119, Section X.

Other layers and additives, such as subbing layers, surfactants, filter dyes, intermediate layers, protective layers, anti-halation layers, barrier layers, development inhibiting compounds, speed-increasing agent, stabilizers, plasticizer, chemical sensitizer, UV absorbers and the like can be present in the radiographic element.

A detailed description of photographic elements and of various layers and additives can be found in Research Disclosure 17643 December 1978, 18431 August 1979, 18716 November 1979, 22534 January 1983, and 308119 December 1989.

The silver halide photographic material of the present invention can be exposed and processed by any conventional processing technique. Any known developing agent can be used into the developer, such as, for example, dihydroxybenzenes (e.g., hydroquinone), pyrazolidones (1-phenyl-3-pyrazolidone or 4,4-dimethyl-1-phenyl-3-pyrazolidone), and aminophenols (e.g., N-methyl-p-aminophenol), alone or in combinations thereof. Preferably the silver halide photographic materials are developed in a developer comprising dihydroxy-benzenes as the main developing agent, and pyrazolidones and p-aminophenols as auxiliary developing agents. More preferably, the silver halide radiographic elements of the present invention are developed in a hardener free developer solution.

Other well known additives can be present in the developer, such as, for example, antifoggants (e.g., benzotriazoles, indazoles, tetrazoles), silver halide solvents (e.g., thiosulfates, thiocyanates), sequestering agents (e.g., aminopolycarboxylic acids, aminopolyphosphonic acids), sulfite antioxidants, buffers, restrainers, hardeners, contrast promoting agents, surfactants, and the like. Inorganic alkaline agents, such as KOH, NaOH, and LiOH are added to the developer composition to obtain the desired pH which is usually higher than 10.

The silver halide photographic material of the present invention can be processed with a fixer, of a typical composition for the application required. The fixing agents include thiosulfates, thiocyanates, sulfites, ammonium salts, and the like. The fixer composition can comprise other well known additives, such as, for example, acid compounds (e.g., metabisulfates), buffers (e.g., carbonic acid, acetic acid), hardeners (e.g., aluminum salts), tone improving agents, and the like.

The exposed radiographic elements can be processed by any of the conventional processing techniques. Such processing techniques are illustrated for example in Research Disclosure, Item 17643, cited above. Roller transport processing is particularly preferred, as illustrated in U.S. Pat. Nos. 3,025,779; 3,515,556; 3,545,971 and 3,647,459 and in UK Patent 1,269,268. Hardening development can be undertaken, as illustrated in U.S. Pat. No. 3,232,761.

As regards the processes for the silver halide emulsion preparation and the use of particular ingredients in the emulsion and in the light-sensitive element, reference is made to Research Disclosure, Item 18,431, August 1979, wherein the following chapters are dealt with in deeper details:

IA. Preparation, purification and concentration methods for silver halide emulsions.
IB. Emulsion types.
IC. Crystal chemical sensitization and doping.
II. Stabilizers, antifogging and antifolding agents.
IIA. Stabilizers and/or antifoggants.
IIB. Stabilization or emulsions chemically sensitized with gold compounds.
IIC. Stabilization of emulsions containing polyalkylene oxides or plasticizers.
IID. Fog caused by metal contaminants.
IIE. Stabilization of materials comprising agents to increase the covering power.
IIF. Antifoggants for dichroic fog.
IIG. Antifoggants for hardeners and developers comprising hardeners.
IIH. Additions to minimize desensitization due to folding.
III. Antifoggants for emulsions coated on polyester bases.
IIJ. Methods to stabilize emulsions at safety lights.
IIK. Methods to stabilize x-ray materials used for high temperature. Rapid Access, roller processor transport processing.
III. Compounds and antistatic layers.
IV. Protective layers.
V. Direct positive materials.
VI. Materials for processing at room light.
VII. X-ray color materials.
VIII. Phosphors and intensifying screens.
IX. Spectral sensitization.
X. UV-sensitive materials
XII. Bases and to Research Disclosure, Item 308119, December 1989, wherein the following chapters are dealt with in deeper details:

I. Emulsion preparation and types
II. Emulsion washing
III. Chemical sensitization
IV. Spectral sensitization and desensitization
V. Brighteners
VI. Antifoggant and stabilizer
VIII. Absorbing and scattering material
IX. Vehicle and vehicle extenders
X. Hardeners
XI. Coating aids
XII. Plasticizers and lubricants
XIII. Antistatic layers
XIV. Methods of addition
XV. Coating and drying procedure
XVI. Matting agents
XVII. Supports
XIX. Processing

SYNTHESIS EXAMPLE

Propyl-4,5-hydro-5-thioxo-1H-tetrazole-1-acetate (10 g) was dissolved in an aqueous ammonia solution (32%, 50 g) and stirred at room temperature for 48 hours. The resulting solution was acidified to pH 1 using concentrated HCl solution, to give a white precipitate of 4,5-hydro-5-thioxo-1H-tetrazole-1-acetamide. The solid was filtered and dried to give the required product (6 g).

Elemental analysis and NMR analysis confirmed the following tautomeric structure:

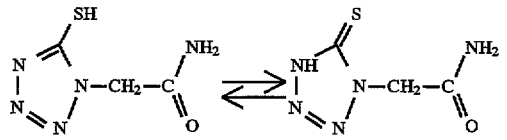

EXAMPLE 1

A silver bromoiodide tabular emulsion comprising less than 3% mol of iodide was prepared by double jet method using controlled pAg. The resulting emulsion had a mean grain size of 1.35 μm and an average grain thickness of 0.19 μm, so obtaining an average aspect ratio of about 7.1. The emulsion was chemically sensitized by conventional gold and sulfur technique and a spectral sensitizer was added during the chemical digestion. The coating finals included azodicarbonamide and resorcinol as conventional antifoggant, as well as dextran and polyethylacrylate latex as gelatin extenders.

A radiographic film 1 (comparison) was obtained by coating the emulsion double sided onto a blue tinted polyester base, at a total silver coating weight of 4.4 g/m$^2$. On both emulsion layers was applied a gelatin top coat with a gelatin thickness of 0.9 μm. The radiographic film was hardened with a divinylsulfone compound.

Radiographic films 2, 3, and 4 were obtained by following the same procedure of film 1, but further adding 0.09, 0.27, and 0.675 mmol/Ag mol of the comparison compound 1, respectively.

Radiographic films 5, 6, and 7 were obtained by following the same procedure of film 1, but further adding 0.09, 0.27, and 0.675 mmol/Ag mol of the invention compound 2, respectively.

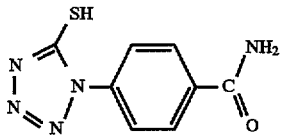

Compound 1 (Comparison)

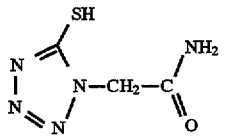

Compound 2 (Invention)

The radiographic films were exposed to blue light using a Wratten™ W98 blue filter, green light using a Wratten™ W99 green filter, and X-ray using an X-ray exposure at 75 Kv and a T8 3M Trimatic™ screen. The evaluation of photographic characteristics was performed both on the fresh samples and on differently aged samples, as indicated in the following Tables 1 and 2.

TABLE 1

| FRESH SAMPLES | | | | | | |
|---|---|---|---|---|---|---|
| Film | J-band | Dmin | Blue Speed | Green Speed | X-ray Speed | Shoulder Contrast |
| 1 (R) | 1603 | 0.19 | 1.95 | 2.38 | 2.21 | 3.48 |
| 2 (C) | 1488 | 0.19 | 1.93 | 2.34 | 2.22 | 3.19 |
| 3 (C) | 1441 | 0.19 | 1.90 | 2.31 | 2.18 | 3.44 |
| 4 (C) | 1326 | 0.18 | 1.85 | 2.24 | 2.12 | 3.63 |
| 5 (I) | 1480 | 0.17 | 1.96 | 2.36 | 2.23 | 3.92 |
| 6 (I) | 1546 | 0.18 | 1.97 | 2.40 | 2.26 | 3.90 |
| 7 (I) | 1610 | 0.19 | 2.00 | 2.42 | 2.30 | 4.01 |

(R) = Reference
(C) = Comparison
(I) = Invention

The data of Tables 1 and 2 show the better performance of the radiographic material comprising the alkylaminomercaptotetrazole of the present invention in terms of speed to Dmin ratio both on fresh and aged samples.

TABLE 2

| AGED SAMPLES | | | | | |
|---|---|---|---|---|---|
| Film | Dmin | Blue Speed | Green Speed | X-ray Speed | Contrast |
| 160 minutes/40% Relative Humidity/70° C. | | | | | |
| 1 (R) | 0.18 | 1.94 | 2.32 | 2.00 | 3.28 |
| 5 (I) | 0.18 | 1.96 | 2.31 | 2.02 | 3.67 |
| 6 (I) | 0.18 | 1.97 | 2.34 | 2.04 | 3.62 |
| 7 (I) | 0.18 | 2.00 | 2.36 | 2.08 | 3.73 |
| 160 Minutes/40% Relafive Humidity/90° C. | | | | | |
| 1 (R) | 0.17 | 1.93 | 2.32 | 1.97 | 3.42 |
| 5 (I) | 0.17 | 2.01 | 2.40 | 2.10 | 3.27 |
| 6 (I) | 0.18 | 2.01 | 2.41 | 2.11 | 3.23 |
| 7 (I) | 0.18 | 2.01 | 2.41 | 2.09 | 3.36 |
| 15 hours/50% Relative Humidity 50° C. | | | | | |
| 1 (R) | 0.18 | 1.96 | 2.37 | 2.25 | 3.07 |
| 2 (C) | 0.19 | 1.95 | 2.36 | 2.25 | 3.10 |
| 3 (C) | 0.18 | 1.91 | 2.31 | 2.21 | 3.18 |
| 4 (C) | 0.18 | 1.86 | 2.25 | 2.16 | 3.27 |
| 5 days/50% Relative Humidity/50° C. | | | | | |
| 1 (R) | 0.19 | 1.91 | 2.33 | 2.26 | 2.89 |
| 2 (C) | 0.19 | 1.91 | 2.33 | 2.26 | 3.17 |
| 3 (C) | 0.19 | 1.88 | 2.29 | 2.23 | 2.85 |
| 4 (C) | 0.18 | 1.82 | 2.21 | 2.15 | 3.02 |
| 3 days/38° C. | | | | | |
| 1 (R) | 0.19 | 1.91 | 2.33 | 2.23 | 2.95 |
| 2 (C) | 0.19 | 1.91 | 2.32 | 2.25 | 2.88 |
| 3 (C) | 0.19 | 1.88 | 2.29 | 2.20 | 2.95 |
| 4 (C) | 0.18 | 1.82 | 2.21 | 2.14 | 3.12 |

(R) Reference
(C) Comparison
(I) Invention

EXAMPLE 2

Radiographic films 1a to 7a were prepared according the same procedure of example 1, but omitting the addition of azodicarbonamide and resorcinol as conventional antifoggant, as well as dextran and polyethylacrylate latex as gelatin extenders.

The radiographic films 1a to 7a were exposed to blue light using a Wratten™™ W98 blue filter, green light using a Wratten™ W99 green filter, and X-ray using an X-ray exposure at 75 Kv and a T8 3M Trimatic™ screen. The evaluation of photographic characteristics was performed on aged samples, as indicated in the following Table 3.

TABLE 3

| Film | Dmin | Dmax | Blue Speed | Green Speed | X-ray Speed | Shoulder Contrast |
|---|---|---|---|---|---|---|
| | Evaluation after 160'/40% R.H. 170° C. | | | | | |
| 1a (R) | 0.18 | 3.15 | 1.81 | 2.26 | 1.88 | 2.39 |
| 2a (C) | 0.185 | 3.48 | 1.83 | 2.30 | 1.91 | 2.47 |
| 3a (C) | 0.18 | 3.43 | 1.80 | 2.25 | 1.90 | 2.45 |
| 4a (C) | 0.18 | 3.52 | 1.75 | 2.19 | 1.83 | 2.50 |
| 5a (I) | 0.19 | 3.36 | 1.84 | 2.26 | 1.93 | 2.60 |
| 6a (I) | 0.19 | 3.43 | 1.87 | 2.34 | 1.96 | 2.65 |
| 7a (I) | 0.185 | 3.52 | 1.83 | 2.32 | 1.93 | 2.93 |

(R) = Reference
(C) = Comparison
(I) = Invention

The results of Table 3 clearly show the improvement of the speed to Dmin ratio obtained with the compound of the present invention. The speed of the radiographic material of the present invention is always higher than or substantially equal to that of the comparison films.

EXAMPLE 3

To demonstrate the unexpected results of the compounds of the present invention, a set of radiographic films were prepared according the same procedure of example 2, but using different alkylmercaptotetrazole compounds, according to the following Table 4.

TABLE 4

| Film | Compound | Amount (mmol/molAg) |
|---|---|---|
| 8 | 3 | 0.05 |
| 9 | 3 | 0.15 |
| 10 | 3 | 0.45 |
| 11 | 4 | 0.05 |
| 12 | 4 | 0.15 |
| 13 | 4 | 0.45 |
| 14 | 5 | 0.05 |
| 15 | 5 | 0.15 |
| 16 | 5 | 0.45 |
| 17 | 6 | 0.05 |
| 18 | 6 | 0.15 |
| 19 | 6 | 0.45 |

The radiographic films were exposed to blue light using a Wratten™ W98 blue filter, green light using a Wratten™ W99 green filter, and X-ray using an X-ray exposure at 75 Kv and a T8 3M Trimatic™ screen. The evaluation of photographic characteristics is indicated in the following Table 5.

TABLE 5

| Film | Dmin | Dmax | X-ray Speed | Contrast |
|---|---|---|---|---|
| 1 (R) | 0.18 | 3.35 | 1.90 | 2.51 |
| 8 (C) | 0.185 | 3.57 | 1.93 | 2.98 |
| 9 (C) | 0.185 | 3.63 | 1.94 | 2.67 |
| 10 (C) | 0.185 | 3.57 | 1.89 | 2.69 |
| 11 (C) | 0.185 | 3,71 | 1.85 | 2.85 |
| 12 (C) | 0.19 | 3.98 | 1.83 | 2.81 |
| 13 (C) | 0.185 | 3.75 | 1.79 | 2.63 |
| 14 (C) | 0.20 | 3.31 | 1.94 | 2.45 |
| 15 (C) | 0.19 | 3.54 | 1.95 | 2.78 |
| 16 (C) | 0.19 | 3.50 | 1.99 | 2.65 |
| 17 (C) | 0.185 | 3.60 | 1.92 | 2.66 |

TABLE 5-continued

| Film | Dmin | Dmax | X-ray Speed | Contrast |
|---|---|---|---|---|
| 18 (C) | 0.185 | 3.58 | 1.50 | 2.85 |
| 19 (C) | 0.185 | 3.56 | 1.78 | 2,73 |

None of the above comparison alkylmercaptotetrazole compounds shows an improvement of the speed to Dmin ratio. On the contrary, all comparison compounds show a higher Dmin and a lower or substantially equal speed, compared to the reference film 1 (equal to film 1 of example 1).

The comparison compounds used for example 3 are listed hereinbelow.

COMPOUND 3

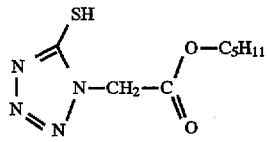

COMPOUND 4

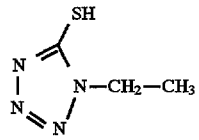

COMPOUND 5

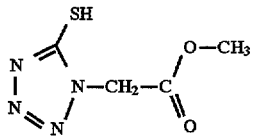

COMPOUND 6

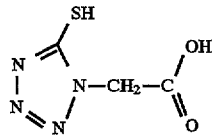

We claim:

1. A light-sensitive silver halide photographic element comprising a support and silver halide emulsion layer or layers coated thereon, characterized in that at least one of said light-sensitive silver halide emulsion layers comprises an alkylaminomercaptotetrazole compound having the following formula:

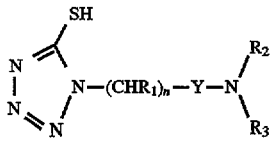

wherein:

Y is a divalent group selected from the group consisting of $—SO_2—$ and

—P(O)OR—, R being hydrogen atom, alkyl group or aryl group, $R_1$, $R_2$ and $R_3$, each equal or different, can be hydrogen atom, alkyl group or aryl group, and n is an integer from 1 to 5.

2. The light-sensitive silver halide photographic element according to claim 1 or 2, wherein said alkylaminomercaptotetrazole compound is present in amount of from 0.01 to 1 millimoles per mole of silver.

3. The light-sensitive silver halide photographic element according to claim 1, wherein said alkylaminomercaptotetrazole compound is present in amount of from 0.05 to 0.8 millimoles per mole of silver.

4. The light-sensitive silver halide photographic element according to claim 1 wherein at least one of said light-sensitive silver halide emulsion layers comprises tabular silver halide grains having an average aspect ratio higher than 3:1 and a thickness lower than 0.4 μm.

5. The light-sensitive silver halide photographic element according to claim 4, wherein the projective area of said tabular grains is higher than 50% with respect to the projective area of all silver halide grains.

6. The element of claim 1 wherein Y is $SO_2$.

7. The element of claim 1 wherein Y is —P(O)OR—.

8. The element of claim 2 wherein Y is $SO_2$.

9. The element of claim 2 wherein Y is —P(O)OR—.

10. A process of using an alkylaminomercaptotetrazole compound of formula:

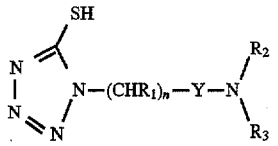

wherein:

Y is a divalent group selected from the group consisting of —$SO_2$— and

—P(O)OR—, R being hydrogen atom, alkyl group or aryl group, $R_1$, $R_2$ and $R_3$, each equal or different, can be hydrogen atom, alkyl group or aryl group, and n is an integer from 1 to 5 to increase the speed to Dmin ratio of a light-sensitive silver halide photographic element comprising a support and silver halide emulsion layer or layers coated thereon, said process comprising adding said alkylaminomercaptotetrazole to said silver halide emulsion layer.

11. The process of claim 10 wherein Y is $SO_2$.

12. The process of claim 10 wherein Y is —P(O)OR—.

* * * * *